US009114609B1

(12) United States Patent
Folkins et al.

(10) Patent No.: US 9,114,609 B1
(45) Date of Patent: Aug. 25, 2015

(54) SYSTEM AND METHOD FOR INK DROP ACCELERATION WITH TIME VARYING ELECTROSTATIC FIELDS

(71) Applicant: Xerox Corporation, Norwalk, CT (US)

(72) Inventors: Jeffrey J. Folkins, Rochester, NY (US); Jing Zhou, Rochester, NY (US); Richard P. Germain, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/279,824

(22) Filed: May 16, 2014

(51) Int. Cl.
*B41J 2/06* (2006.01)
*B41J 2/045* (2006.01)

(52) U.S. Cl.
CPC ..... *B41J 2/04588* (2013.01); *B41J 2/04578* (2013.01)

(58) Field of Classification Search
USPC ..... 347/55
See application file for complete search history.

(56) References Cited

U.S. PATENT DOCUMENTS

| | | | | |
|---|---|---|---|---|
| 3,673,601 A | | 6/1972 | Hertz | |
| 3,893,131 A | | 7/1975 | Perel et al. | |
| 4,752,783 A | * | 6/1988 | Saito et al. | 347/55 |
| 5,305,016 A | | 4/1994 | Quate | |
| 5,430,470 A | | 7/1995 | Stortz | |
| 5,646,659 A | * | 7/1997 | Moriyama et al. | 347/55 |
| 5,815,178 A | * | 9/1998 | Silverbrook | 347/55 |
| 5,838,349 A | * | 11/1998 | Choi et al. | 347/55 |
| 5,975,683 A | | 11/1999 | Smith et al. | |
| 6,079,814 A | | 6/2000 | Lean et al. | |
| 6,508,540 B1 | | 1/2003 | Lean et al. | |
| 7,070,260 B2 | | 7/2006 | Mutz et al. | |
| 7,758,159 B2 | | 7/2010 | Onozawa | |

FOREIGN PATENT DOCUMENTS

JP 2000025249 A * 1/2000

OTHER PUBLICATIONS

Machine generated English translation of JP2000-025249 "Ink-Jet Recording Apparatus and Method for Controlling Electric Field in Ink-Jet Recoridng Apparatus" to Miura et al.; retrieved via https://www4.j-platpat.inpit.go.jp/ on Mar. 25, 2015; 24 pp.*

* cited by examiner

*Primary Examiner* — Shelby Fidler
(74) *Attorney, Agent, or Firm* — Maginot Moore & Beck LLP

(57) ABSTRACT

An inkjet printer includes an electrode in either a printhead or an image receiving member that is operatively connected to a waveform generator. During operation, a controller operates the waveform generator to generate an electrostatic field between the printhead and the image receiving member during operation of inkjets in the printhead to eject ink drops. The controller operates the waveform generator to reduce an amplitude of the electrostatic field while the ink drops travel toward the image receiving member during a time when satellite ink drops can be formed from the ejected ink drops. The controller subsequently operates the waveform generator to generate the electrostatic field while the ink drops are in flight after formation of the satellite to accelerate the ink drops and satellites towards the image receiving member.

16 Claims, 6 Drawing Sheets

SYSTEM AND METHOD FOR INK DROP ACCELERATION WITH TIME VARYING ELECTROSTATIC FIELDS

TECHNICAL FIELD

This disclosure relates generally to printers and, more specifically, to inkjet printers that use electrostatic fields to affect ejected ink drops before the ink drops reach an image receiving member.

BACKGROUND

Inkjet printers operate a plurality of inkjets in each printhead to eject liquid ink onto an image receiving member. The ink can be stored in reservoirs that are located within cartridges installed in the printer. Such ink can be aqueous ink, UV Curable, ink emulsions, or phase-change inks. Phase-change inkjet printers receive ink in a solid form and then melt the solid ink to produce liquid ink for ejection onto the imaging member. The printer supplies ink to printheads for ejection through inkjets onto an image receiving member of an image receiving member, such as a print medium or an indirect imaging belt or imaging drum. Liquid inks dry or are cured and phase change inks cool into a solid state after being transferred to a print medium, such as paper or any other suitable medium for printing.

In an inkjet printer, an ejected ink drop travels through air for a predetermined distance before reaching an image receiving member. Examples of image receiving members include paper or other print media, or indirect imaging members such as imaging drums or endless belts that receive ink images for later transfer to a print medium. Printers are generally configured to minimize the "time of flight", which is the time delay between ejection of an ink drop and arrival of the ink drop on image receiving member. Longer time of flight delays tend to result in poorer placemen of ink drops and may result in a degradation of printed image quality. In an inkjet printer, the time of flight for ejected ink drops is influenced by both the distance between the printhead and the image receiving member and the velocity profile of the ink drop as the ink drop moves from the inkjet to the image receiving member. The velocity of the ink drop tends to decrease after ejection due to the presence of drag from the air around the ink drop. Thus, as the distance between the printhead and the image receiving member increases, the flight time increases both due to the increased distance and due to the reduction in ink drop velocity due to drag. Additionally, inkjet printheads eject ink drops at a maximum velocity that is related to the volume of the ink drop. In general, the printheads eject ink drops with larger volumes at higher initial velocities than ink drops with smaller volumes.

Given the limitations cited above, many printers place the printheads in close proximity to the image receiving member with gaps of, for example, one millimeter or less between the inkjets in the printhead and the image receiving member. Additionally, the printers often eject ink drops with greater volumes to minimize the time of flight for the ink drops. The close proximity of printheads to an image receiving member can result in damage or contamination of the printheads, particularly when the image receiving member is paper or another print medium that may make contact with the printhead. Additionally, some printed images are reproduced with higher quality when the printhead is configured to eject smaller ink drops. The drop placement errors that result from the increased time of flight for the smaller ink drops may preclude the use of smaller ink drop sizes during an imaging operation, however.

One approach to reducing ink drop time of flight that is known to the art uses an electrostatic field (E-field) to accelerate an ink drop from the printhead face to the image receiving member. The printhead ejects the ink drop using an ordinary actuator, such as a piezoelectric transducer or a thermal actuator, but the ink drop receives a static electric charge as the ink drop leaves the printhead. The electrostatic field generated between the printhead and the image receiving member produces a charge with an opposite polarity on the image receiving member, and the attraction between the charged ink drop and the image receiving member accelerates the ink drop and reduces the time of flight in comparison to ejecting the ink drop in the absence of the electrostatic field.

While electrostatic fields are known to the art, the electrostatic fields also affect in-flight ink drops in ways that tend to contaminate printheads that effectively prevent the use of electrostatic fields in widely deployed inkjet printers. As is known in the art, inkjets eject some ink drops in a manner where a larger ink drop is accompanied by one or more smaller "satellite" ink drops. In some instances, a satellite ink drop is formed from a larger ink drop after the larger ink drop is ejected from an inkjet. If the satellite ink drops land on the image receiving member in close proximity to the larger ink drop, then the quality of the printed image is preserved. However, in a printer that uses an electrostatic field, some of the satellite ink drops are formed with the charge polarity of the image receiving member instead of the printhead. For example, if the electrostatic field forms a positive charge on the ink drops and a negative charge on the image receiving member, some of the satellite ink drops receive a negative charge. The negative charge repels the satellite ink drops from the image receiving member and attracts the satellite ink drops back to the printhead, where the ink contaminates the printhead and results in clogged inkjets. Over time, the ink contamination due to the electrostatic field degrades the quality of printed images and increases the requirements for cleaning and maintenance of the printheads. In light of these deficiencies, improvements to printers that enable printing ink drops with reduced time of flight while reducing or eliminating printhead contamination would be beneficial.

SUMMARY

In one embodiment, an inkjet printer that applies a time-varying electrostatic field between a printhead and an image receiving surface to control the flight of ejected ink drops has been developed. The inkjet printer includes a printhead having at least one inkjet with an actuator configured to eject ink drops through a nozzle in the printhead towards a surface of an image receiving member in response to receiving an electrical firing signal, a waveform generator configured to generate a time-varying output signal, an electrode operatively connected to the waveform generator to generate an electrostatic field in response to the time-varying output signal, and a controller operatively connected to the printhead and the waveform generator. The controller is configured to generate the electrical firing signal to operate the actuator and eject an ink drop from the inkjet toward the image receiving member, operate the waveform generator to generate an electrostatic field from the electrode for a first predetermined period of time to generate a first charge on the ink drop and a second charge at the image receiving member, the first charge having opposite polarity from the second charge, operate the waveform generator to reduce an amplitude the electrostatic field for a second predetermined time after the first predetermined time and prior to the ink drop reaching the image receiving member, and operate the waveform generator to generate the electrostatic field for a third predetermined time after the second predetermined time and before the ink drop reaches the image receiving member to accelerate the ink drop and a satellite ink drop toward the image receiving member, the satellite ink drop separating from the ink drop during the second predetermined time.

In another embodiment, a method for operating an inkjet printer that applies a time-varying electrostatic field between a printhead and an image receiving surface to control the flight of ejected ink drops has been developed. The method includes generating with a controller operatively connected to an inkjet in a printhead an electrical signal to operate an actuator in the inkjet and eject an ink drop from the inkjet toward an image receiving member, generating with a waveform generator an electrostatic field through an electrode for a first predetermined time to generate a first charge on the ink drop ejected by the inkjet and a second charge on the image receiving member, the first charge having opposite polarity from the second charge, reducing an amplitude of the electrostatic field with the waveform generator for a second predetermined time after the first predetermined time and prior to the ink drop reaching the image receiving member, and generating with the waveform generator the electrostatic field through the electrode for a third predetermined time after the second predetermined time and before the ink drop reaches the image receiving member to accelerate the ink drop and a satellite ink drop toward the image receiving member, the satellite ink drop separating from the ink drop during the second predetermined time.

BRIEF DESCRIPTION OF THE DRAWINGS

The foregoing aspects and other features of a printer that is configured to accelerate ink drops using an electrostatic field while reducing or eliminating ink contamination of printheads are described below.

DETAILED DESCRIPTION

Figure 1A:
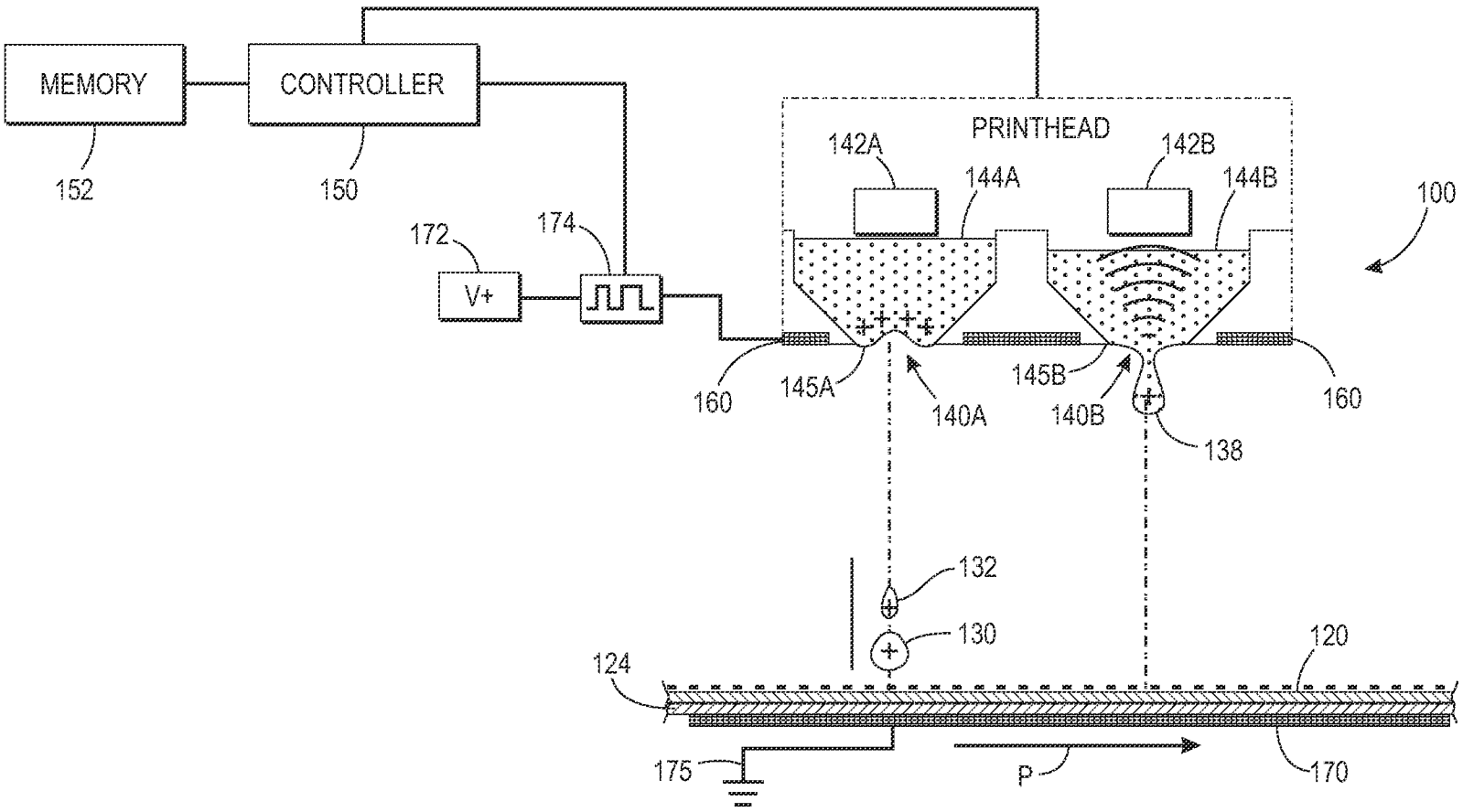
FIG. 1A is a profile view of a print zone including ink ejectors in a printhead and a printhead electrode that generates an electrostatic field with a time-varying output signal to accelerate ink drops from the printhead toward an image receiving member.

For a general understanding of the present embodiments, reference is made to the drawings. In the drawings, like reference numerals have been used throughout to designate like elements. As used herein, the terms "printer" generally refer to an apparatus that applies an ink image to print media and can encompass any apparatus, such as a digital copier, bookmaking machine, facsimile machine, multi-function machine, etc., which performs a print outputting function for any purpose. The printer prints ink images on an image receiving member, and the term "image receiving member" as used herein refers to print media or an intermediate member, such as a drum or belt, which carries an ink image and transfers the ink image to a print medium. "Print media" can be a physical sheet of paper, plastic, or other suitable physical substrate suitable for receiving ink images, whether precut or web fed. As used in this document, "ink" refers to a colorant that is liquid when applied to an image receiving member. For example, ink can be aqueous ink, UV curable ink, ink emulsions, melted phase change ink, or gel ink that has been heated to a temperature that enables the ink to be liquid for application or ejection onto an image receiving member and then return to a gelatinous state. A printer can include a variety of other components, such as finishers, paper feeders, and the like, and can be embodied as a copier, printer, or a multifunction machine. An image generally includes information in electronic form, which is to be rendered on print media by a marking engine and can include text, graphics, pictures, and the like.

The term "printhead" as used herein refers to a component in the printer that is configured to eject ink drops onto the image receiving member. A typical printhead includes a plurality of inkjets that are configured to eject ink drops of one or more ink colors onto the image receiving member. The inkjets are arranged in an array of one or more rows and columns. In some embodiments, the inkjets are arranged in staggered diagonal rows across a face of the printhead. Various printer embodiments include one or more printheads that form ink images on the image receiving member. Some printer embodiments include a plurality of printheads arranged in a print zone. An image receiving member, such as a print medium or an intermediate member that holds a latent ink image, moves past the printheads in a process direction through the print zone. The inkjets in the printheads eject ink drops in rows in a cross-process direction, which is perpendicular to the process direction across the image receiving member. An individual inkjet in a printhead ejects ink drops that form a line extending in the process direction as the image receiving member moves past the printhead in the process direction.

As used herein, the terms "electrical firing signal," "firing signal," and "electrical signal" are used interchangeably to refer to an electrical energy waveform that triggers an actuator in an inkjet to eject an ink drop. Examples of actuators in inkjets include, but are not limited to, piezoelectric, thermally heated and electrostatic actuators. A piezoelectric actuator includes a piezoelectric transducer that changes shape when the firing signal is applied to the transducer. The transducer proximate to a pressure chamber that holds liquid ink, and the change in shape of the transducer urges some of the ink in the pressure chamber through an outlet nozzle in the form of an ink drop that is ejected from the inkjet.

FIG. 1A depicts a portion of a print zone 100 and other components in an inkjet printer. The print zone 100 includes a printhead 102, and an image receiving member 124. A digital controller 150 is operatively connected to the printhead 102 and to a waveform generator 174 that is operatively connected to a positive voltage source 172 and an electrode 160 in the printhead 102. The waveform generator 174 generates a positive time-varying output signal to generate and reduce an amplitude of an electrostatic field between the printhead 102 and the image receiving member 124 to control the flight of ink drops and satellite ink drops during operation of the printhead 102. FIG. 1A includes a simplified illustration of the printhead 102 that depicts two inkjets 140A and 140B. While the printhead 102 is depicted with two inkjets for illustrative purposes, more typical printhead embodiments include hundreds or thousands of inkjets formed in the printhead. The print zone 100 includes one or more printheads that eject ink drops in response to electrical firing signals to form printed images.

The controller 150 includes one or more programmable digital logic devices that execute programmed instructions. The instructions and data required to perform the programmed functions are stored in a memory 152 that is operatively connected to the controller 150. The memory 152 includes volatile data storage devices such as random access memory (RAM) and non-volatile data storage devices including magnetic and optical disks or solid state storage devices. The processors, their memories, and interface circuitry configure the controllers and/or print engine to perform the functions, such as the difference minimization function, described above. These components are provided on a printed circuit card or provided as a circuit in an application specific integrated circuit (ASIC). In one embodiment, each of the circuits is implemented with a separate processor device. Alternatively, the circuits can be implemented with discrete components or circuits provided in VLSI circuits. Also, the circuits described herein can be implemented with a combination of processors, ASICs, discrete components, or VLSI circuits.

In some inkjet printer embodiments, the functionality of the controller 150 is implemented using multiple devices. In some printer configurations, the controller 150 includes a separate digital logic device each printhead, such as the printhead 102, that generates the electrical firing signals for the inkjets in a single printhead in conjunction with one or more electrical amplifier circuits. The controller 150 also includes another digital control device that receives digital data corresponding to printed images and generates binary image data for one or more printheads that the individual printhead controllers use to control the operation of inkjets in order to form printed patterns of ink drops during a printing operation.

Figure 1B:
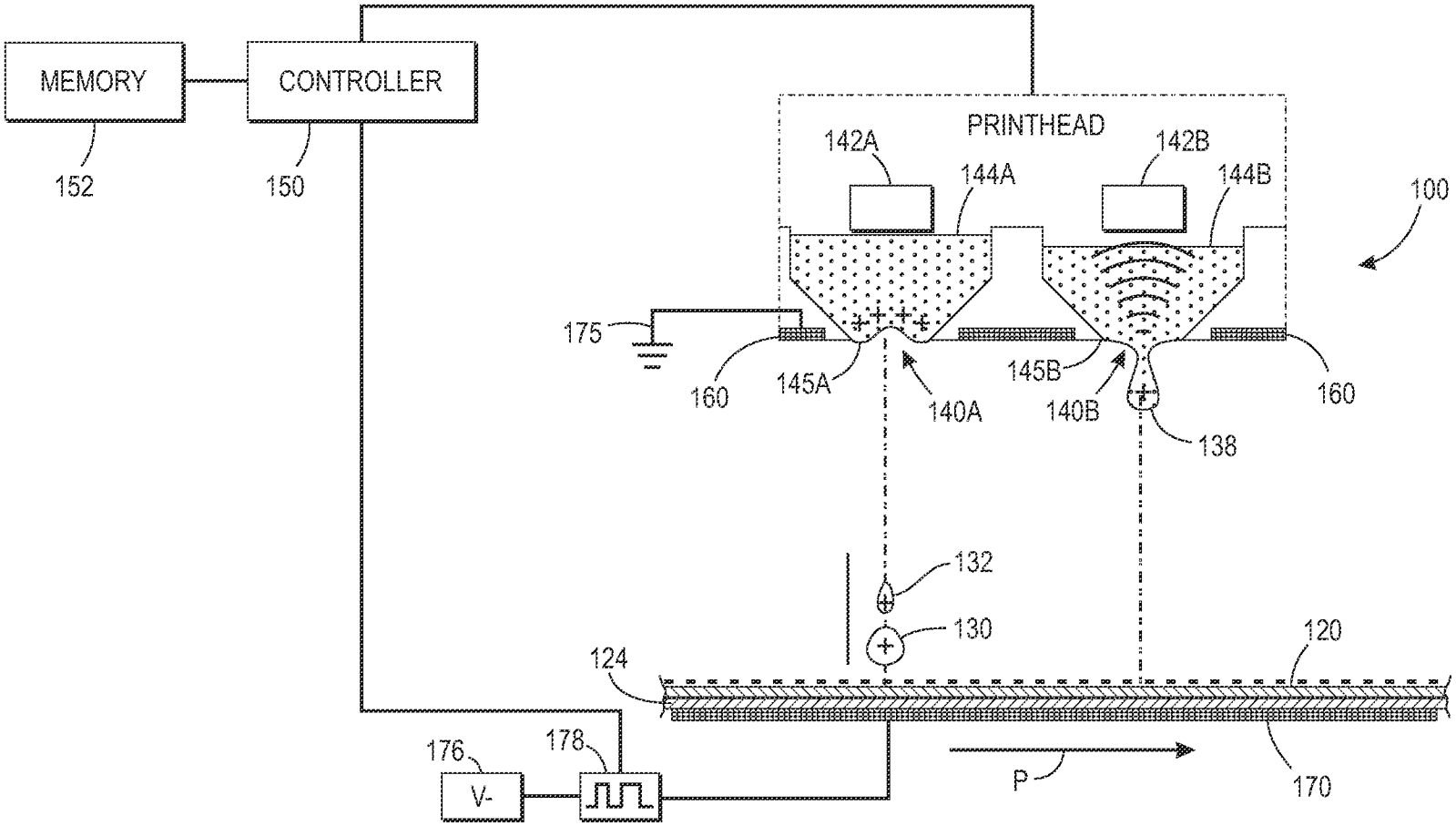
FIG. 1B is a profile view of a print zone including ink ejectors in a printhead and an electrode operatively connected to an image receiving member that generates an electrostatic field with a time-varying output signal to accelerate ink drops from the printhead toward the image receiving member.

The portion of the controller 150 in the printhead operates the inkjets in the printhead at a predetermined clock frequency. In the embodiment of FIG. 1A and FIG. 1B, the controller 150 is also configured to operate the waveform generators 174 and 178, respectively, to control the generation of output signals for an electrode 160 in the printhead 102 (FIG. 1A) or an electrode 170 that is operatively connected to the image receiving member 124 in a region of the image receiving member that receives ink drops from the printhead 102 (FIG. 1B). While FIG. 1A and FIG. 1B depict a configuration that generates a positive charge on the printhead 102 and a negative charge on the image receiving member 124, in an alternative embodiment the printhead 102 receives a negative charge, the ejected ink drops and satellite ink drops receive a negative charge, and the image receiving member 124 and print medium 120 receive a positive charge.

In the printhead 102, the inkjets 140A and 140B include actuators 142A and 142B and pressure chambers 144A and 144B, respectively. The pressure chambers 144A and 144B store liquid ink that is ejected through nozzles 145A and 145B in the inkjets 140A and 140B, respectively, in response to an electrical signal that operates the actuators 142A or 142B, respectively. In one embodiment, the actuators 142A and 142B are piezoelectric transducers that deform a diaphragm (not shown) into the pressure chambers 144A and 144B, respectively, in response to receiving an electrical firing signal. Each transducer generates pressure in the pressure chamber that urges ink through the nozzle of the inkjet. The ink forms a drop that travels toward the image receiving member 124. In another printhead configuration, each of the actuators is a thermal actuator that heatsink in a pressure chamber to form a bubble. The bubble expands and forces ink through a nozzle to eject the ink drop.

The inkjets in the printhead 102 receive electrical firing signals from the controller 150. The electrical firing signals are generated in a synchronized manner according to a predetermined clock signal. For example, clock signals in a range of 1 KHz to 50 KHz are commonly used in inkjet printers. The controller 150 generates firing signals for the actuators in the inkjets in the printhead in a synchronized manner with the clock signals. During a printing operation, each inkjet does not necessarily eject an ink drop during every clock cycle. Instead, the controller 150 selectively activates individual inkjets or groups of inkjets over a series of clock cycles to form a printed pattern on the image receiving member 124 and print medium 120 move through the print zone 100 in the process direction P. Because the inkjets in the printhead eject ink drops in a synchronized manner, the inkjets in a printhead that are activated during a given clock cycle eject ink the ink drops at substantially the same time and the ink drops have substantially the same flight time to reach the image receiving member. As described below, the controller 150 controls the application of electricity to an electrode in the print zone to activate and deactivate the electrostatic field in a synchronized manner with the clock signal. Since the ink drops are ejected in a synchronous manner, a single cycle of the dynamic electrostatic field accelerates each of the ink drops that are ejected from the printhead during a single cycle of the clock signal.

Figure 2:
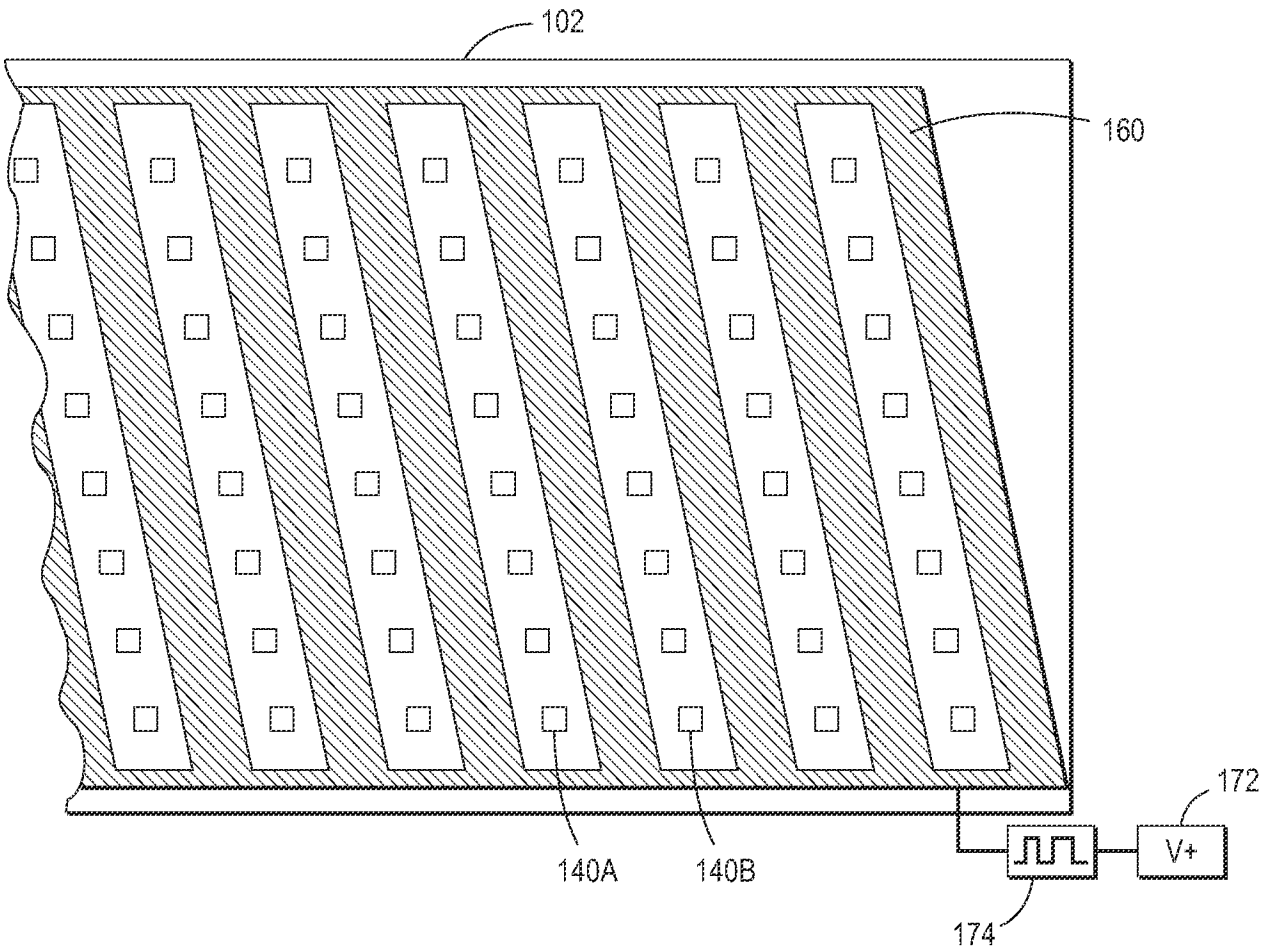
FIG. 2 is a diagram of a printhead face including nozzles for a plurality of inkjets and an illustrative embodiment of an electrode that generates an electrostatic field in the printhead.

In FIG. 1A, the printhead 102 includes an electrode 160 that is formed in the face of the printhead 102 around the nozzles 145A and 145B of the inkjets 140A and 140B, respectively. As described in more detail below, the electrode 160 receives an output signal from a waveform generator 174 to generate a positive electrostatic charge in the ink that is ejected from the printhead 102. The positive electrostatic charge repels ink drops having the positive charge from the printhead 102 to accelerate the ink drops toward the image receiving member 124. The electrode 160 is, for example, an etched copper trace formed on a printed circuit board (PCB) or other substrate layer in the printhead 102. In FIG. 1A, another electrode 170 is formed in the image receiving member 124 and is electrically connected to ground 175. The electrode 170 is, for example, a conductive plate or a flexible layer of electrically conductive material that is formed in the image receiving member 124. FIG. 2 depicts the face of the printhead 102 with an array of inkjets, including the inkjets 140A and 140B, with the electrode 160.

In FIG. 1A, the printhead 102 includes an electrode 160 that is formed in the face of the printhead 102 around the nozzles 145A and 145B of the inkjets 140A and 140B, respectively. The electrode 160 receives the output signal from the waveform generator 174 to generate a positive electrostatic charge in the ink that is ejected from the printhead 102. The positive charge is induced within an ink drop if the ink drop is ejected in the presence of an electric field and the ink has at least a partial electrical conductivity and/or a high dielectric constant. With the charge trapped within the ejected ink drop, the electrostatic field across the printhead to image receiver gap accelerates the charged ink drops toward the image receiving member 124. While FIG. 1A and FIG. 1B depict a configuration where the printhead 102 and the ejected ink drops receive a positive charge and the image receiving member 124 receives a negative charge to attract the ink drops and satellite ink drops, in another configuration the printhead 102 and ejected ink drops receive a negative charge and the image receiving member 124 receives a positive charge.

In FIG. 1A, a waveform generator 174 receives positive voltage from a positive voltage source 172 and generates a time-varying output signal for the electrode 160. The waveform generator 174 is, for example, an analog or digital signal modulation circuit including one or more amplifiers that is configured to generate different waveform outputs to control the electrostatic field. In one embodiment, the waveform generator is embodied as a solid-state switch, such as a power MOSFET or other solid-state switching device that is operatively configured to switch in a frequency range of between approximately 10 KHz and 1 MHz depending upon the frequency of operation for the inkjets in the printhead 102. The solid-state switch acts as a chopper to generate the electrostatic field waveforms described below. The waveform generator 174 generates a time varying electrostatic field between the printhead face and the image receiving member to control the generation of electrical charges on potential satellite ink drops so that the satellite ink drops are attracted to the image receiving member instead of toward the face of the printhead. In one embodiment, the waveform generator 178 in FIG. 1B uses the same hardware implementation as the waveform generator 174. A digital controller 150 is operatively connected to the printhead 102 and waveform generators 174 or 178.

FIG. 1B depicts another configuration of the inkjet printer and print zone of FIG. 1A. FIG. 1B depicts many of the same components in FIG. 1A, but in FIG. 1B the electrode 160 in the printhead 102 is connected to ground 175 instead of to a waveform generator. Instead, in FIG. 1B the electrode 170 in the image receiving member 124 is connected to a waveform generator 178, which receives electrical power from a negative voltage source 176. In the illustrative embodiment of FIG. 1B, the waveform generator 178 has the same design as the waveform generator 174 and the waveform generator 178 produces a negative voltage output signal for the electrode 170 with a peak level of approximately −2,000 volts, which is same magnitude as the output from the waveform generator 174. The controller 150 is operatively connected to the waveform generator 178 to generate a negative voltage waveform for the electrode 170.

The negative electrode 170 receives the output signal from the waveform generator 178 to generate a negative charge on the image receiving member 124 and on the print medium 120. The negative charge on the electrode 170 produces an electrostatic field in the print zone that generates a positive charge on the printhead 102 and the ink drops that are ejected from the printhead. The controller 150 operates the waveform generator 178 to apply and reduce the amplitude of the electrostatic field through the electrode 170 in the same manner as the waveform generator 174 for the electrode 160 to produce a charge on ink drops and to ensure that the satellite ink drops do not return to the printhead 102.

FIG. 1A and FIG. 1B depict the ejection of two ink drops from the inkjets 140A and 140B in the printhead 102. Ink drop 130 is an ink drop that was ejected from the inkjet 140A, and the ink drop 132 is a satellite ink drop that separates from the ink drop 130 after the ink drop 130 is ejected from the inkjet 140A. The surfaces of both the ink drops 130 and 132 have a positive electrical charge and the ink drops are attracted to the negative electrical charge in the print medium 120 and image receiving member 124.

The inkjet 140B is depicted during the process of ejecting an ink drop. In the inkjet 140B, the actuator 142B receives an electrical firing signal and generates the pressure wave 143 that urges an ink drop through the nozzle 145B of the inkjet 140B. An ink ligament 138 is formed during the ejection process prior to the separation of an ink drop from the liquid ink in the pressure chamber 144B. As depicted in FIG. 1B, the ligament 138 receives a positive charge as the ink drop is ejected from the nozzle 145B and separates from the ink in the pressure chamber 144B. The ejected ink drop retains the positive charge from the ligament 138.

While FIG. 1A and FIG. 1B depict ejected ink drops 130 and 132 in the same illustration as the ligament 138, in the print zone 100 the printhead 102 ejects ink drops with a velocity and frequency that enables ink drops to be ejected in synchronized groups that reach the print medium 120 or another image receiving member prior to the ejection of the subsequent group of ink drops. Thus, in one embodiment, the ink drops 130 and 132 reach the print medium 120 shortly before the inkjet 140B receives an electrical firing signal to eject the ink drop depicted by the ligament 138. As described below, in the print zone 100, the controller 150 and waveform generators 174 or 178 apply and reduce the amplitude of the electrostatic field to control the application of electrical charge to the ink drops as the ink drops are ejected from the printhead 102. In many printheads that include a large number of inkjets, the controller 150 generates firing signals and operates the waveform generators 174 or 178 to control the generation of the electrostatic field for groups of ink drops that are ejected together to form the printed image. As described above, the inkjets in a printhead operate in a synchronized manner according to a clock cycle, and the waveform generators 174 or 178 control the application and reduce the amplitude of the electrostatic field for each group of ejected ink drops. The process of generating and reduce the amplitude of the electrostatic field ensures that satellite ink drops are formed with an electrical charge that has the same polarity as the printhead 102 and the opposite polarity of the image receiving member 124.

Figure 3:
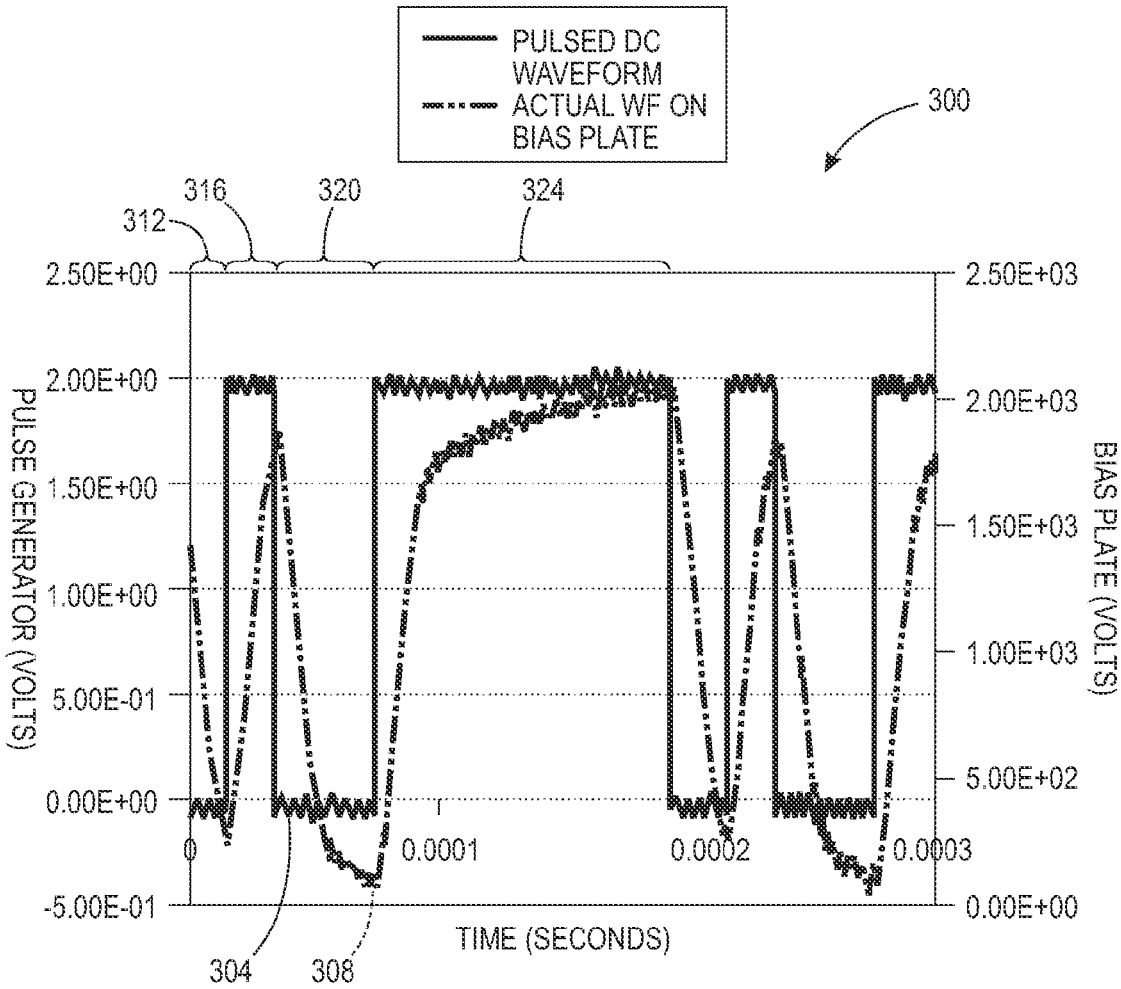
FIG. 3 is a timing diagram of an exemplary waveform for generation of a time varying electrostatic field in an inkjet printer.

FIG. 3 depicts a graph 300 of a pulsed DC waveform and measured voltage levels on an electrode over time in one embodiment of the print zone 100. In the graph 300, the rectangular waveform 304 depicts the output of the waveform generator that is applied to an electrode to generate a time varying electrostatic field in the print zone. For example, in the time periods 316 and 324, the controller 150 operates the waveform generator 174 to apply the positive voltage to the printhead electrode 160 or the controller 150 operates the waveform generator 178 to apply negative voltage source 176 to the electrode 170 in the configurations of FIG. 1A and FIG. 1B, respectively. The waveform generators 174 and 178 generate an electrostatic field during the time periods 316 and 324. While FIG. 3 depicts a positive voltage output signal, the waveform generator 178 produces a similar waveform with negative peak amplitudes instead of the positive peak amplitudes in FIG. 3. The waveform generators 174 or 178 generate time-varying outputs that drop to substantially zero volts during time periods 312 and 320 to reduce the amplitude of the electrostatic field from the region between the printhead 102 and image receiving member 120. In particular, the time period 320 corresponds to a specific time during which the ejected ink drops are in flight and have the potential to split apart and form satellite ink drops. Satellite ink drops that are formed in the presence of a strong electric field experience the polarizing effect of the field, which has the potential to reverse the charge polarity between the main drop and the split satellite drop rather than simply sharing the same charge between the split drops. Hence the waveform generators 174 or 178 reduce the amplitude of the electrostatic field to ensure that satellite ink drops do not receive a charge that is opposite the charge on the printhead 102 so that the satellite ink drops are not attracted back towards the printhead 102. FIG. 3 depicts a control signal and electrode voltage curves that correspond to a printhead operating period of approximately 195 microseconds, which corresponds to a firing signal rate of approximately 5.13 KHz.

In FIG. 3, the graph 304 depicts the ideal instantaneous change in voltage levels, while the graph 308 depicts a measured ramp in the electrode voltage over time due to various factors including capacitance and resistance in the electrode 160. The peak voltage level in the signal from the waveform generator in the example of FIG. 3 is 2,000 volts, but alternative configurations of the print zone in a printer can include a higher or lower peak voltage level. In the embodiment of FIG. 3, the voltage levels are depicted as positive voltage levels, although a similar waveform is used with negative voltage levels. As describe above, the polarity of the electrical charge can be either positive or negative as long as the ejected ink drops and satellite ink drops have an electrical charge with the same polarity as the printhead and opposite that of the image receiving member.

Figure 4:
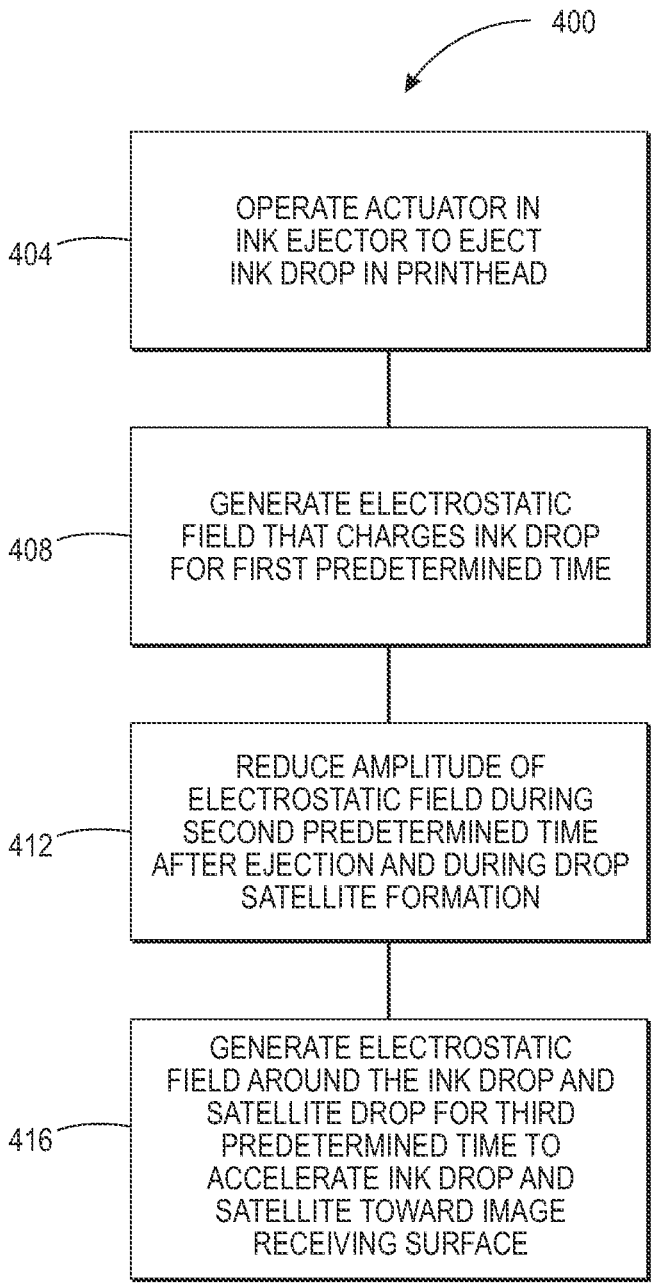
FIG. 4 is a block diagram of a process for operating a printer using a time-varying electrostatic field to reduce the time of flight for ink drops while reducing or eliminating contamination of the printhead due to satellite ink drops.

FIG. 4 depicts a process 400 for operation of a dynamic electrostatic field in a print zone during a printing operation. In the description below, a reference to the process 300 performing a function or action refers to the execution of stored program instructions by a controller, such as the controller 150, to perform the function or action in conjunction with one or more components in the printer. Process 400 is described in conjunction with the embodiments of FIG. 1A and FIG. 1B and the electrostatic field waveform graph of FIG. 3 for illustrative purposes.

Process 400 begins as the controller 150 generates an electrical firing signal to operate the actuators in one or more of the inkjets in the printhead 102 (block 404). As depicted in FIG. 1A and FIG. 1B, the piezoelectric transducer in the actuator 142B receives an electrical firing signal from the controller 150 and generates a pressure wave 143 to urge ink from the pressure chamber 144B through the nozzle 145B in the inkjet 140B. Referring to FIG. 3, the controller 150 begin the generation of electrical firing signals for one or more inkjets in the printhead beginning at time zero in the graph 300. The controller 150 operates the waveform generators 174 or 178 to generate output signals for the electrodes 160 or 170, respectively, during the initial time period 312 after commencement of the firing signal as the actuators in the inkjets begin operation to eject ink drops. In FIG. 3, the time period 312 is approximately 15 microseconds in length.

Process 400 continues as the controller 150 applies the voltage source to the electrode to generate the electrostatic field for a first predetermined time period (block 408). In the embodiment of FIG. 1A, the controller 150 operates the waveform generator 174 to produce an output signal for the electrode 160 to generate an electrostatic field between the printhead 102 and the image receiving member 124. In the embodiment of FIG. 1B, the controller 150 operates the waveform generator 178 to generate the electrostatic field through the electrode 170 in a similar manner. The electrostatic field is generated during the first time period to generate a positive charge on an ink drop as the ink drop is formed in a ligament, such as the ligament 138, and as the ink drop is ejected from the from printhead 102. The electrostatic field also generates a negative charge on the image receiving member 124 and the print medium 120. As depicted in FIG. 3, the controller 150 applies the voltage sources 172 or 176 to the electrodes 160 or 170, respectively, for approximately 20 microseconds during time period 316 as the ink drop is initially ejected from the inkjet.

Process 400 continues as the controller 150 operates the waveform generator to reduce the amplitude of the electrostatic field between the printhead 102 and the image receiving member 124 (block 412). In the configuration of FIG. 1A, the controller 150 operates the waveform generator 174 to reduce the amplitude of the output signal to zero volts or to a substantially lower amplitude than the peak output level for the electrostatic field. In the configuration of FIG. 1B, the controller 150 operates the waveform generator 178 in a similar manner to reduce the amplitude of the output signal to zero volts or to a substantially lower amplitude than the peak output level for the electrostatic field.

The second time period occurs after the inkjets in the printhead 102 have ejected ink drops and the ink drops are in-flight between the printhead 102 and the image receiving member 124 and during the period of time when some of the ejected ink drops are most likely to form satellite ink drops. For example, in FIG. 1A and FIG. 1B, a portion of the ink in the ink drop 130 separates from the ejected ink drop and forms the satellite ink drop 132 after the ink drop 130 is ejected. The satellite ink drop 132 is formed during a time when no substantial electrostatic field is formed between the printhead 102 and the image receiving member 124. Thus, the satellite ink drop 132 maintains the same positive electrostatic charge as the parent ink drop 130. As depicted in FIG. 3, the controller 150 operates the waveform generators 174 and 178 to reduce the amplitude of the electrostatic field for approximately 40 microseconds during time period 320 as the ink drop is initially ejected from the inkjet. Of course, satellite ink drop formation does not necessarily occur for every ink drop that is ejected from the printhead 102. The ink drops that do not form satellites retain the positive charge and continue toward the image receiving member 124.

Process 400 continues as the controller operates the waveform generator to generate the electrostatic field around the ink drop and the satellite ink drop for a third predetermined time (block 416). In the configuration of FIG. 1A, the controller 150 operates the waveform generator 174 to generate a positive electrostatic field through the electrode 160. In the configuration of FIG. 1B, the controller 150 operates the waveform generator 178 to produce an output signal through the electrode 170 that generates the electrostatic field between the printhead 102 and image receiving member 124. FIG. 3 depicts the third predetermined time period 324 where the waveform generator produces an output signal for the electrode with a peak voltage magnitude of approximately 2,000 volts. The time period 324 has a duration of approximately 120 microseconds in the configuration of FIG. 3. During the third time period, the electrostatic field accelerates the ink drops and satellite ink drops toward the image receiving member 124. Because the satellite ink drops retain the same positive charge as the parent ink drops, the electrostatic field also accelerates the satellite ink drops toward the image receiving member and prevents the satellite ink drops from returning the to the face of the printhead 102.

Figure 5A:
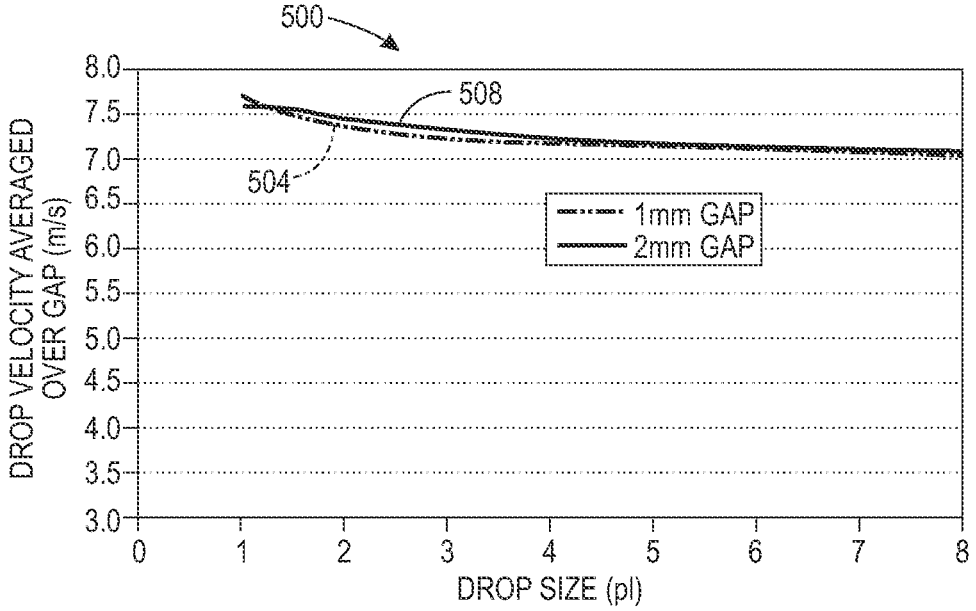
FIG. 5A is a graph depicting average velocities of different ink drops volumes between a printhead and an image receiving member using time varying electrostatic fields to accelerate the ink drops.

FIG. 5A depicts a profile graph 500 of average ink drop velocities for different ink drop volumes using the printer configuration of FIG. 1A or FIG. 1B with the dynamic electrostatic field generation process described herein. In the graph 500, the curves 504 and 508 depict average ink drop velocities for gaps of 1 millimeter and 2 millimeters between the printhead face and the image receiving member, respectively. As seen in the graph 500, the dynamic electrostatic field accelerates the ink drops to counteract the forces of aerodynamic drag and enables the ink drops with the lowest volume of one or two picoliters to have the highest average velocity. Thus, even though the ink drops with the smallest volumes have the lowest initial ejection velocities, the dynamic electrostatic field accelerates the smaller ink drops to have the highest average ink drop velocity, while also increasing the average velocity for all of the ink drop sizes. The overall range of average velocities is similar for the one millimeter gap in the curve 504 and the two millimeter gap in curve 508.

Figure 5B:
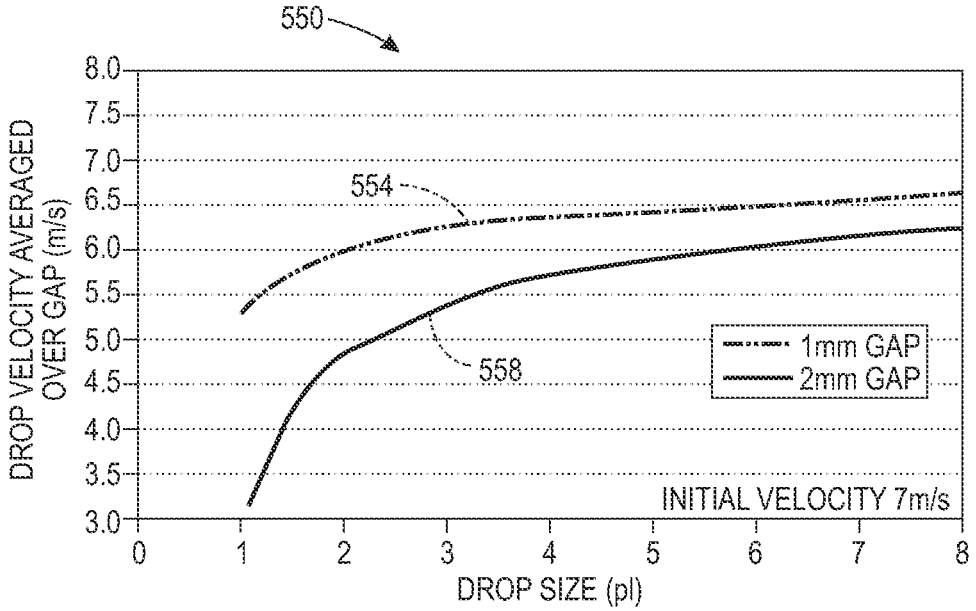
FIG. 5B PRIOR ART
FIG. 5B is a graph depicting average velocities of different ink drops volumes between a printhead and an image receiving member using time varying electrostatic fields to accelerate the ink drops.

FIG. 5B depicts a profile graph 550 of average ink drop calculated velocities for different ink drop volumes prior art printer that does not employ any electrostatic field. In the graph 550, the curves 554 and 558 depict average ink drop velocities for gaps of 1 millimeter and 2 millimeters between the printhead face and the image receiving member, respectively. As depicted in FIG. 5B, the smaller ink drop volumes of less than three or four picoliters have substantially lower average velocities than the larger ink drop volumes due slowing of the drops from aerodynamic drag or air resistance. Additionally, this aerodynamic drag on the ink drops produces a large discrepancy in average ink drop velocity between the curves 554 for the 1 millimeter gap (higher velocity) and the curve 554 with the 2 millimeter gap (lower velocity). Thus, the graph 500 in FIG. 5A clearly depicts the increased average calculated ink drop velocity levels and increased uniformity between ink drop velocities for different ink drop volumes and printhead to image receiving member gaps that are produced using an electrostatic field compared to the prior art. Furthermore, using a dynamic electrostatic field ensures that the face of the printhead is not contaminated with satellite ink drops during the operation of the printer.

In the embodiments described above, the inkjets in the printheads eject ink drops in synchronized groups and the controller adjusts the amplitude of the electrostatic field for entire groups of ink drops to prevent satellite ink drops from receiving a charge that attracts the satellite ink drops to the printhead face instead of the image receiving member. Each group of ink drops reaches the image receiving member prior to ejection of a subsequent group of ink drops. In other embodiments, multiple groups of ink drops are in flight simultaneously for printheads that eject ink drops at a faster rate than the time of flight for the ink drops to the image receiving member. In these embodiments, the printer also applies a time-varying electrostatic field between the printhead and image receiving member to ensure than an ejection time period, such as the time period 316 in FIG. 3, and the satellite forming time periods, such a time period 320 in FIG. 3, do not overlap between different groups of ejected ink drops. In the high-frequency embodiment, the time period of the waveform pulse generation, which of course is the same frequency as the ejection sequencing, can be much shorter than the time of travel from drop ejection to drops arriving at the media.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet printer comprising:

a printhead having at least one inkjet with an actuator configured to eject ink drops through a nozzle in the printhead towards a surface of an image receiving member in response to receiving an electrical firing signal;

a waveform generator configured to generate a time-varying output signal;

an electrode operatively connected to the waveform generator to generate an electrostatic field in response to the time-varying output signal; and a controller operatively connected to the printhead and the waveform generator, the controller being configured to:

generate the electrical firing signal to operate the actuator and eject an ink drop from the inkjet toward the image receiving member;

operate the waveform generator to generate an electrostatic field from the electrode for a first predetermined period of time of approximately 20 microseconds to generate a first charge on the ink drop and a second charge at the image receiving member, the first charge having opposite polarity from the second charge;

operate the waveform generator to reduce an amplitude the electrostatic field for a second predetermined time of approximately 40 microseconds after the first predetermined time and prior to the ink drop reaching the image receiving member; and operate the waveform generator to generate the electrostatic field through the electrode for a third predetermined time of approximately 120 microseconds after the second predetermined time and before the ink drop reaches the image receiving member to accelerate the ink drop and a satellite ink drop toward the image receiving member, the satellite ink drop separating from the ink drop during the second predetermined time.

2. The printer of claim 1, the electrode being operatively connected to the printhead and configured to generate the electrostatic field with a positive charge on a face of the printhead, and a negative charge on the image receiving member.

3. The printer of claim 1, the electrode being operatively connected to the image receiving member and configured to generate the electrostatic field with a negative charge on the image receiving member and a positive charge on a face of the printhead.

4. The printer of claim 1, the electrode being operatively connected to the printhead and configured to generate the electrostatic field with a negative charge on a face of the printhead, and a positive charge on the image receiving member.

5. The printer of claim 1, the electrode being operatively connected to the image receiving member and configured to generate the electrostatic field with a positive charge on the image receiving member and a negative charge on a face of the printhead.

6. The printer of claim 1, wherein the image receiving member is a print medium and the electrode is formed in a member that supports the print medium.

7. The printer of claim 1, the controller being further configured to operate the waveform generator to generate the electrostatic field through the electrode for the first predetermined time beginning approximately 15 microseconds after commencement of the generation of the electrical signal to operate the actuator.

8. The printer of claim 1 wherein the waveform generator generates a signal with a peak voltage of approximately 2000 volts.

9. A method of operating an inkjet printer comprising:

generating with a controller operatively connected to an inkjet in a printhead an electrical signal to operate an actuator in the inkjet and eject an ink drop from the inkjet toward an image receiving member;

generating with a waveform generator an electrostatic field through an electrode for a first predetermined time of approximately 20 microseconds to generate a first charge on the ink drop ejected by the inkjet and a second charge on the image receiving member, the first charge having opposite polarity from the second charge;

reducing an amplitude of the electrostatic field with the waveform generator for a second predetermined time of approximately 40 microseconds after the first predetermined time and prior to the ink drop reaching the image receiving member; and generating with the waveform generator the electrostatic field through the electrode for a third predetermined time of approximately 120 microseconds after the second predetermined time and before the ink drop reaches the image receiving member to accelerate the ink drop and a satellite ink drop toward the image receiving member, the satellite ink drop separating from the ink drop during the second predetermined time.

10. The method of claim 9, the electrode being operatively connected to the printhead and the waveform generator generating a positive charge on a face of the printhead through the electrode and a negative charge on the image receiving member.

11. The method of claim 9, the electrode being operatively connected to the image receiving member and the waveform generator generating a negative charge through the electrode and a positive charge on a face of the printhead.

12. The method of claim 9, the electrode being operatively connected to the printhead and the waveform generator generating a negative charge on a face of the printhead through the electrode and a positive charge on the image receiving member.

13. The method of claim 9, the electrode being operatively connected to the image receiving member and the waveform generator generating a positive charge on the image receiving member through the electrode and a negative charge on a face of the printhead.

14. The method of claim 9, wherein the image receiving member is a print medium and the electrode is formed in a member that supports the print medium.

15. The method of claim 9, further comprising:

generating with the waveform generator the electrostatic field through the electrode for the first predetermined time beginning approximately 15 microseconds after commencement of the generation of the electrical signal to operate the actuator.

16. The method of claim 9, the generation of the electrostatic field further comprising:

generating with the waveform generator a signal with a peak voltage of approximately 2000 volts.

* * * * *